United States Patent [19]

Konya

[11] 4,233,094

[45] Nov. 11, 1980

[54] EXPLOSIVE COMPOSITION FORMING NO WATER AS A REACTION PRODUCT DURING DETONATION

[76] Inventor: Calvin J. Konya, 6990 Summers Rd., Huntsburg, Ohio 44046

[21] Appl. No.: 3,365

[22] Filed: Jan. 15, 1979

[51] Int. Cl.[3] ..... C06B 33/04

[52] U.S. Cl. ..... 149/43; 149/61; 149/71

[58] Field of Search ..... 149/43, 71, 61, 72

[56] References Cited

U.S. PATENT DOCUMENTS

| | | | |
|---|---|---|---|
| 2,836,484 | 5/1958 | Streng et al. | 149/43 X |
| 3,886,008 | 5/1975 | Cook | 149/43 |

*Primary Examiner*—Stephen J. Lechert, Jr.

[57] ABSTRACT

An explosive composition wherein no water is added and no water is formed as a reaction product during detonation. The composition is oxygen balanced and contains no hydrogen.

5 Claims, No Drawings

EXPLOSIVE COMPOSITION FORMING NO WATER AS A REACTION PRODUCT DURING DETONATION

Conventional high-explosive compounds and mixtures generally have hydrogen-containing, organic compounds in eitherthe oxidizing agent, fuel, sensitizer, or in all three. In addition, the elements nitrogen, oxygen and carbon are present. It is desirable that explosive compositions be formulated so that they have a zero or near zero oxygen balance. This means that the elements hydrogen, nitrogen, oxygen and carbon are so proportioned that in the gases resulting from detonation all of the hydrogen reacts to form water, the nitrogen when released forms molecular nitrogen, and the carbon reacts with the oxygen to form carbon dioxide. Hence, if there is only sufficient oxygen present in the reactants to form water from the hydrogen, carbon dioxide from the carbon and molecular nitrogen from the combined nitrogen, the explosive composition is said to be oxygen balanced. A deficiency in oxygen will result in the formation of carbon monoxide or carbon, and an excess of oxygen will result in the formation of oxides of nitrogen rather than molecular nitrogen. Where an excess or deficiency of oxygen is present such will yield a low heat of explosion and thus a less effective explosive performance.

Currently all conventional high explosives form water as a reaction product of detonation. In addition, in some explosives water is added to the composition for purposes of forming a slurry.

It has been found, however, that in explosives used in explosive-fracturing applications wherein fracturing of rock formations is accomplished to increase the flow of earth strata contained fluid, such as natural gas and oil from said formations, it is desirable that no water be introduced. If water is introduced during or incident to explosive fracturing the flow rate of the earth strata contained fluid will be decreased.

It is accordingly the primary object of this invention to provide an explosive composition which produces no water as a reaction product of detonation.

In accordance with the invention this is achieved by having an explosive composition that is hydrogen free. Conventional explosive compositions contain either molecular water or ingredients which contain hydrogen and thus in either case water results in the gases formed during the detonation reaction. More specifically any explosive which contains ammonium nitrate, nitroglycerin or nitrostarch or any hydrogen-containing sensitizer will form water incident to the detonation reaction.

With the present invention the explosive composition is water-free in that no water is added and by the use of inorganic components there is no hydrogen present to form water during detonation. Likewise, the composition of the explosive is oxygen balanced for explosion efficiency. The following are the composition limits of the invention with the components being adjusted to provide an oxygen-balanced composition:

| Ingredient | Composition, Weight % | | | |
|---|---|---|---|---|
| | Broad | Preferred | Preferred | Preferred |
| Sodium nitrate | 59 to 85 | 74 to 85 | 65 to 73 | 59 to 81 |
| Powdered Aluminum | Up to 35 | Up to 20 | 21 to 35 | Up to 33 |
| Carbon Black | Up to 15 | 6 to 15 | Up to 6 | Up to 14 |

An optional inorganic sensitizer may be used in the amount of 1 to 10% by weight, which sensitizer is preferably carbon tetrachloride.

By way of demonstration of the invention a series of tests were conducted with explosive compositions wherein sodium nitrate was used as the oxidizer. Crushed prills of sodium nitrate were mixed with powdered aluminum and carbon black. The density was controlled when necessary by adding microspheres in the ratio of about 1% by weight so that "dead pressing" would not result. Dead pressing results when explosives are too dense and voids are not present in sufficient number to allow propagation of the reaction. The composition of each of the specimens tested is given in Table I.

TABLE I

| Mixture Number | Percent by Weight Ingredients (Rounded to Nearest Percent) | | | | | | | |
|---|---|---|---|---|---|---|---|---|
| | 1 | 2 | 3 | 4 | 5 | 6 | 7 | 8 |
| Sodium Nitrate | 85 | 82 | 80 | 76 | 74 | 71 | 68 | 65 |
| Aluminum | 0 | 5 | 10 | 15 | 20 | 25 | 30 | 35 |
| Carbon | 15 | 13 | 10 | 9 | 6 | 4 | 2 | 0 |

Upon detonation the products of reaction for each of the test specimens of Table I were $Co_2$, $Al_2O_3$, $N_2$ and $Na_2O$. No water was formed as a reaction product of detonation. By determining the magnitude of energy released during detonation by cratering tests in soil, it was determined that the energy release was maximum when the aluminum powder in the mixture was within the range of 21 to 36% by weight. The crater tests were accomplished by burying two pounds of explosives at different depths until the maximum volume of material was ejected from the resulting crater. The maximum crater volumes were compared for each mixture and used to compare energy release.

A second series of tests were conducted using specimens with the compositions listed in Table II.

TABLE II

| Mixture Number | Percent by Weight of Ingredients (Rounded to Nearest Whole %) | | | | | | | | | | | | | | |
|---|---|---|---|---|---|---|---|---|---|---|---|---|---|---|---|
| | 9 | 10 | 11 | 12 | 13 | 14 | 15 | 16 | 17 | 18 | 19 | 20 | 21 | 22 | 23 |
| Sodium Nitrate | 81 | 78 | 75 | 72 | 69 | 67 | 64 | 62 | 76 | 74 | 71 | 68 | 65 | 62 | 59 |
| Carbon Tetrachloride | 5 | 5 | 5 | 5 | 5 | 5 | 5 | 5 | 10 | 10 | 10 | 10 | 10 | 10 | 10 |
| Aluminum | 0 | 5 | 10 | 15 | 20 | 25 | 30 | 33 | 0 | 5 | 10 | 15 | 20 | 25 | 31 |
| Carbon | 14 | 12 | 10 | 8 | 6 | 3 | 1 | 0 | 14 | 11 | 9 | 7 | 5 | 3 | 0 |

In this series of tests the sensitizer in the specimens was carbon tetrachloride, as a low-boiling point inorganic liquid sensitizer. The results of these tests showed that there was more energy released during detonation when the sensitizer carbon tetrachloride was used, and again maximum efficiency resulted with aluminum within the range of 21 to 35%. The products of detonation contained no water.

The maximum crater volume which resulted from the detonation of each mixture was used to compare energy release. Between the 0–20% range of powdered aluminum in the mixture the crater volume increased gradually as the percentage of aluminum increased. When the ratio of powdered aluminum was above 20% the crater volume was significantly increased and was greater than double the volume achieved at 20% aluminum or less. This held true in all tests with or without the addition of carbon tetrachloride. The addition of carbon tetrachloride increased the crater volume in all tests when compared to the results from similar oxygen balanced mixtures which contained no carbon tetrachloride. A crater volume increase of as much as 20% was observed with the addition of carbon tetrachloride.

From the above tests and specific examples of the invention it may be seen that from the standpointof maximum energy release powdered aluminum within the range of 21 to 36% is optimum either with or without carbon tetrachloride within the range of 1 to 101 %.

I claim:

1. A water-free and hydrogen-free explosive composition consisting essentially of, in percent by weight, 65 to 73% sodium nitrate, 21 to 35% powdered aluminum and up to 6% carbon black, said explosive composition being oxygen balanced and forming no water as a reaction product during detonation.

2. The explosive composition of claim 1 having 74 to 85% sodium nitrate, up to 20% powdered aluminum and 6 to 15% carbon black.

3. The explosive composition of claim 1 having 59 to 81% sodium nitrate, up to 33% powdered aluminum and up to 14% carbon black.

4. The explosive composition of claims 1, 4 or 3 having an inorganic sensitizer within the range of 1 t 10%.

5. The explosive compositions of claims 1, 4 or 3 having carbon tetrachloride as an inorganic sensitizer within the range of 1 to 10%.

* * * * *

UNITED STATES PATENT OFFICE

CERTIFICATE OF CORRECTION

Patent No. 4,233,094 Dated Nov. 11, 1980

Inventor(s) Calvin J. Konya

It is certified that error appears in the above-identified patent and that said Letters Patent are hereby corrected as shown below:

Column 4, line 2, "101%" should be --10%--.

Claim 4, line 1, "4" should read --2--;

Claim 5, line 1, "4" should read --2--.

Signed and Sealed this

*Tenth* Day of *February 1981*

[SEAL]

*Attest:*

RENE D. TEGTMEYER

*Attesting Officer*

*Acting Commissioner of Patents and Trademarks*